US005176316A

United States Patent [19]

Whitman

[11] Patent Number: 5,176,316

[45] Date of Patent: Jan. 5, 1993

[54] SYSTEM FOR ALLEVIATING AND REDUCING MOISTURE BENEATH A ROOFING STRUCTURE

[76] Inventor: Robert E. Whitman, 2465 Knights Hill La., Toledo, Ohio 43614

[21] Appl. No.: 627,226

[22] Filed: Dec. 14, 1990

[51] Int. Cl.[5] ..... F24F 7/007

[52] U.S. Cl. ..... 236/44 C; 454/239; 454/251

[58] Field of Search ..... 52/194, 1; 98/29, 31, 98/33.1, 39.1, 42.04; 34/104, 232; 236/49.1, 49.3, 44 C

[56] References Cited

U.S. PATENT DOCUMENTS

| | | | |
|---|---|---|---|
| 1,931,066 | 10/1933 | Eckert | 98/31 |
| 2,969,027 | 1/1961 | Figge | 98/31 X |
| 4,432,273 | 2/1984 | Devitt | 98/29 X |
| 4,534,119 | 8/1985 | Glicksman | 98/31 X |
| 4,829,882 | 5/1989 | Jackson | 236/49.1 X |

FOREIGN PATENT DOCUMENTS

| | | | |
|---|---|---|---|
| 1609923 | 4/1970 | Fed. Rep. of Germany | 98/31 |
| 80139 | 4/1988 | Japan | 236/49.1 |
| 161334 | 7/1988 | Japan | 236/49.1 |
| 123934 | 5/1989 | Japan | 236/49.1 |
| 2100315 | 12/1982 | United Kingdom | 52/199 |

*Primary Examiner*—Harold Joyce
*Attorney, Agent, or Firm*—George R. Royer

[57] ABSTRACT

An air ventilating system for use to ventilate and dehydrate and dehumidify the insulation immediately under the roof structure. The system includes an air intake member, to draw in relatively dry air, generally located above the roof surface, and a central distribution member, in the form of a plenum, disposed above or below the roof structure, and a plurality of radiating pipes that lead from the distribution plenum member, and which are located above, below or at the same level as the insulation layer under the roof structure, with such distribution pipes having a plurality of small openings therein to disperse air to the surrounding insulation layers for purposes of aerating same to remove moisture from the insulation. The system includes a humidity and temperature sensing device to detect the relative moisture content and temperature levels of the air both within and external to the roof infrastructure, with automatic sensing means to turn on or off the dehumidifying system at intervals dependent on predetermined temperature levels and humidity levels both within and outside the building.

2 Claims, 4 Drawing Sheets

SYSTEM FOR ALLEVIATING AND REDUCING MOISTURE BENEATH A ROOFING STRUCTURE

DISCUSSION OF PRIOR ART AND BACKGROUND OF INVENTION

The subject invention relates to environmental control devices utilized in roofing systems in general, and is directed to an apparatus and system for controlling moisture levels inside the building and particularly within and adjacent the insulation layers adjacent the the roof deck in a building. The subject invention is basically adapted to draw relatively dry air from outside the building at times when the relative humidity of the outside air is at a low level and thence ingest same and disperse same through a series of pipes which empty the relatively dry air into the insulation layers that are generally emplaced immediately beneath the roof structure.

In this latter respect, most buildings of recent vintage, irrespective of whether a pitched roof or a flat roof is employed, usually have a layer of insulation placed either immediately below the roof level for heat preservation purposes. This instulatin layer, in flat roofs, as used generally in commercial buildings, is frequently juxtaposed immediately below the undersurface of the flat roof. In some installations there may be a relatively narrow air gap between the undersurface of the roof deck and the insulation layer, which gap is provided for circulation purposes for purposes of alleviating the moisture problem in the insulation layers.

There have been an array of inventions conceived and produced to dehydrate the insulation material so as to prevent damage to the roof and building infrastructure. Several such inventions have been structured as simple ventilating systems that do nothing more than direct air currents over a portion of the insulation layer controlled mechanically arbitrarily by an operator. However, none of the known systems have utilized an integral system that effectively provides a controlled flow of relatively drive air both within and immediately outside the insulation material. The subject system is not to be confused with air conditioning systems used in modern buildings. None of the known systems, including automatic air conditioning systems, provide any methodology for automatically controlling air characteristics in the roof structure itself. It is this state of art and general problem area that gives rise to the conception of the subject invnetion, and the following designated objects of the subject invneiton are directed accordingly.

OBJECTS

It is an object of the subject invention to provide an improved ventilating system for dehumidifying insulation materials disposed immediately beneath a roof structure;

It is an additional object of the subject invention to provide an improved ventilating system for aerating and dehumidifying an insulation system under a building roof structure;

Yet another object of the subject invention is to provide an improved dehumidifying system for a building;

Still another object of the subject invention is to provide an improved apparatus for drying the insulation layer and other components under a building roof structure;

It is another object of the subject invention to provide an improved air ventilating system of a roof structure that is based on an automatic sensing system;

Other and further objects of the subject invention will become apparent from a reading of the following description taken in conjunction with the claims.

DRAWINGS

DESCRIPTION OF GENERAL EMBODIMENT AND SUMMARY OF INVENTION

The subject invention is an air ventilating system for use to ventilate and dehydrate and dehumidify the insulation immediately under the roof structure. The system includes an air intake member, to draw in relatively dry air, generally located above the roof surface, and a central distribution member, in the form of a plenum, disposed above or below the roof structure, and a plurality of radiating pipes that lead from the distribution plenum member, and which are located above, below or at the same level as the insulation layer under the roof structure, with such distribution pipes having a plurality of small openings therein to disperse air to the surrounding insulation layers for purposes of aerating same to remove moisture from the insulation. The system includes a humidity and temperature sensing device to detect the relative moisture content and temperature levels of the air both within and external to the roof infrastructure, with automatic sensing means to turn on or off the dehumidifying system at intervals dependent on predetermined temperature levels and humidity levels both within and outside the building.

DESCRIPTION OF PREFERRED EMBODIMENT

In describing the preferred embodiment of the subject invention, it must be stressed that this preferred embodiment is only one embodiment of the subject invention, as other embodiments fall within the scope of the claims. Therefore, the following description shall not be construed to limit the scope of the claims herein.

Figure 1:
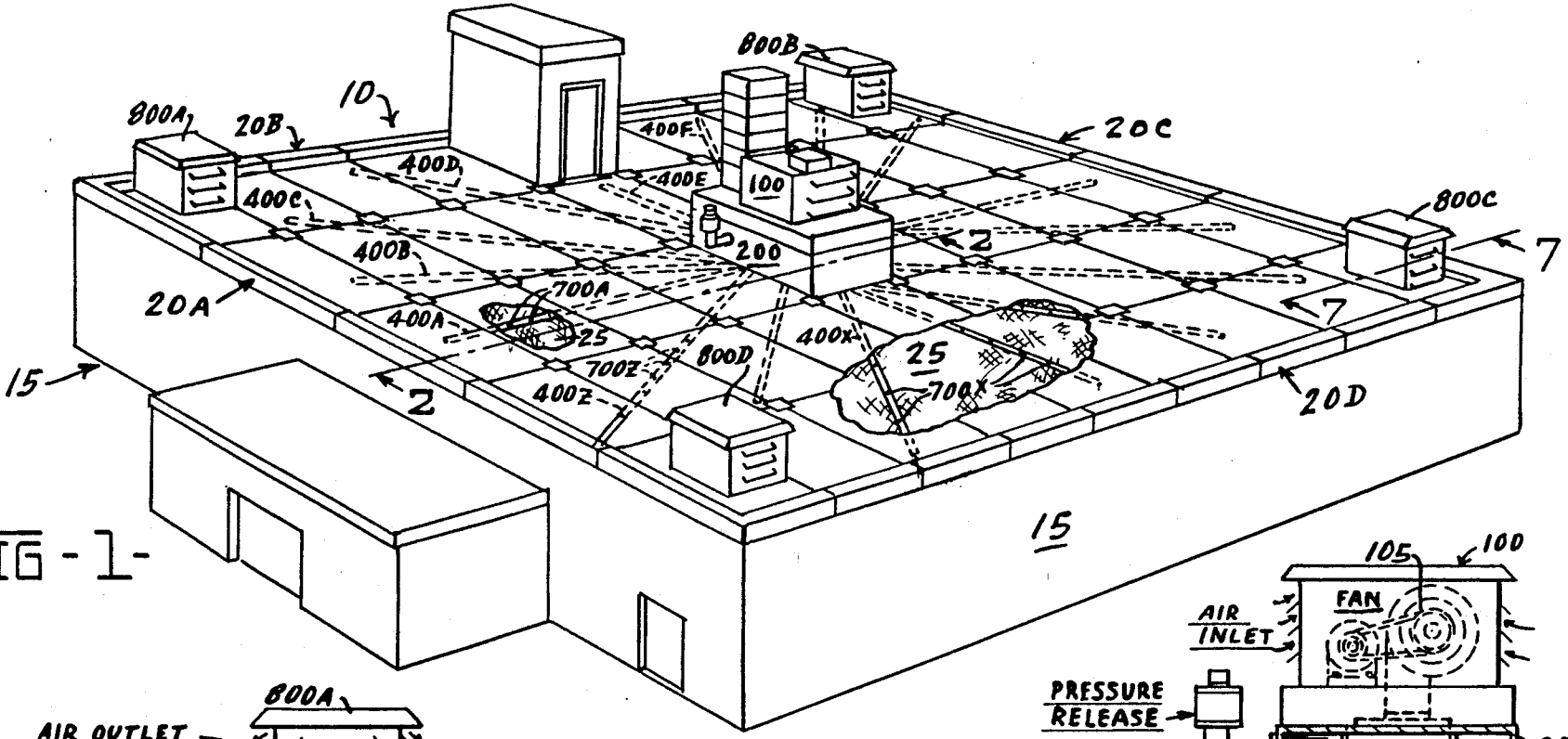
FIG. 1 is a perspective view of the subject ventilating system, as shown from above a building showing how the subject system looks under the roof of the building.
Figure 2:
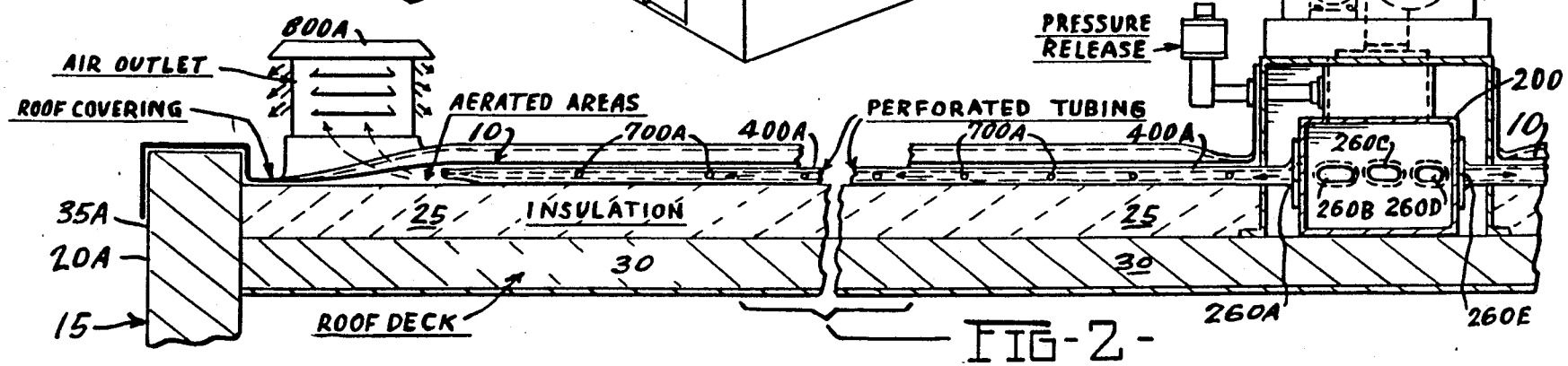
FIG. 2 is a side elevational view in section of the subject ventilating system showing the location of the subject ventilating system beneath the roof structure.

Referring to the drawings and particularly FIGS. 1 and 2, an overall view of the installation of the subject invneiton is shown as it is emplaced in a roof structure 10 on a building structure 15. Further, the apparatus described below may be installed or retrofitted into an existing building structure. Specifically, as shown, the subject apparatus encompassing the subject invention is a dehydrating apparatus for removing moisture from the insulation layer 25 immediately under the upper roof structure 10 as such roof structure is utilized as a protective layer over building 26 as can be seen from the drawings. The subject apparatus generally comprises as its major elements the following members: First, there is an air intake member 100 preferably located on the upper surface of the roof 10, as shown, or at some location outside the building to facilitate the collection of air. Located immediately beneath the air intake member 100 is the distribution plenum 200 designed and equipped to take air from the air intake member and distribute such air through a network of distributed pipes 400A, 400B . . . 400Z in order to disperse air through the insulation layer 10. Disposed at various terminal points in the air distribution pipes are air outlet openings 700A . . . 700Z equipped to distribute air to the various parts of the system. Finally, there are air exit means 1000 at the terminal locations to allow excess air escape from the building 15.

It is to be noted that building structure shown in the drawings and described below is relatively conventional, with a flat roof structure. While depiction of this type of roof structure is used herein, it is not to be construed as limiting the scope of the subject invention herein to such types of roof structures or building types.

Attention is again addressed to FIGS. 1 and 2 in which the roof 10 and building structure 15 interrelationship is shown, and as seen, the building 15 is graphically displayed and represented as a conventional rectangular structure with the horizontal roof 10 disposed on the upper portion thereof. As can be determined from a view of FIG. 1, the roof 10 covers the upper part of the building 15, with the roof extending laterally to the upper perimeter edges of 20A, 20B, 20C and 20D of the building 15. Such perimeter edges are generally defined by the upper edges of the building sides such as building side 25A shown in FIG. 2.

As can be seen from FIG. 2, the general roof infrastructure generally comprises a lower rigid deck 30, which may be metal or wood, which lower deck provides the base structural support for the roof infrastructure. A horizontally disposed insulation layer 25 is usually emplaced horizontally over the top of the roof deck 30 as shown. This insulation layer 25 functions to prevent the escape of rising heated air in the building and generally helps to retain air temperature levels inside the building at optimal levels. In many applications the external, upper roof covering 10 is then emplaced in a generally horizontal and flush manner over the upper surface of the insulation layer 25, as can be determined from a view of FIG. 2. In many more recent and modern applications, roof covering 10 is comprised of rubber sheath. At this point, it must be emphasized that the structural principles of the subject invention remain generally applicable even though the foregoing roof structure may vary, such as when the insulation layer is disposed beneath the roof deck 30, or when other than rubber materials are used for roof 10, or whatever other structural arrangement may be utilized. Moreover, it is to be noted that the distribution pipes 400A, 400B . . . 400Z as used in the subject apparatus, are shown in FIG. 2 as being disposed in the roof infrastructure as being placed between the roof covering 10 and the insulation layer 25. It is to be known in this respect, that such distribution pipes may feasibly be located beneath the insulation layer 25 or in the insulation layer, at the same vertical and horizontal level as the insulation level.

Figure 3:
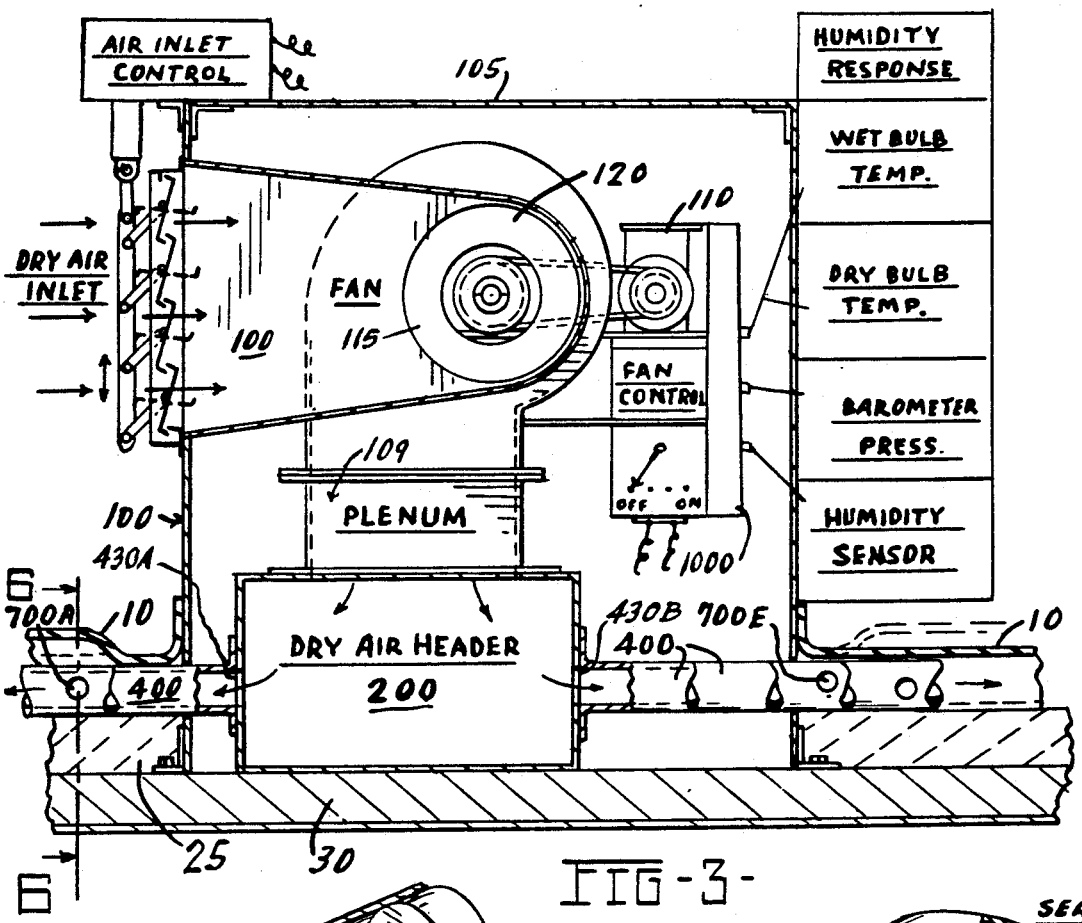
FIG. 3 is a side elevational view of the subject system showing the intake system and distribution plenum.
Figure 4:
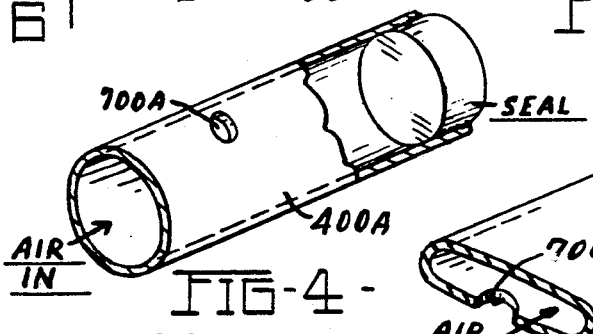
FIG. 4 is a perspective view partially cut away to show a distribution pipe member of the rigid genre.
Figure 5:
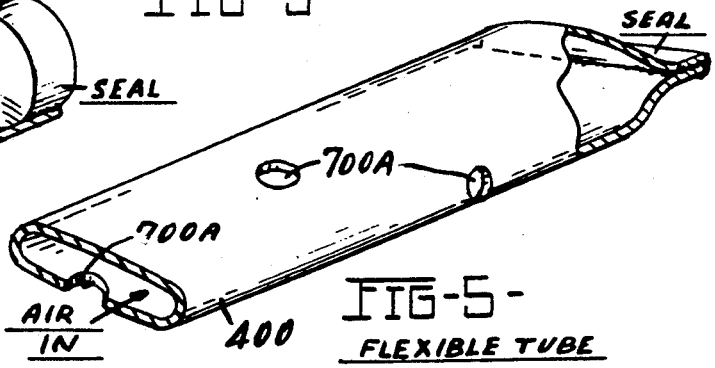
FIG. 5 is a perspective view partially cut away to show distribution pipe of the flexible genre.
Figure 6:
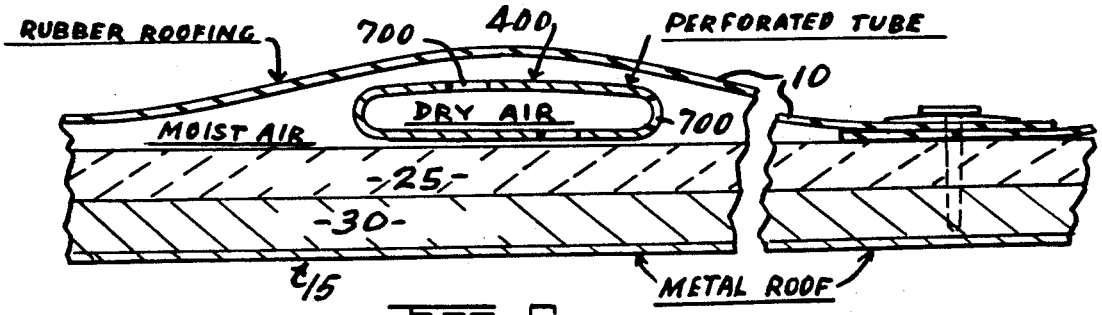
FIG. 6 is an end elevational view showing how the subject air distribution system pipes appear with a schematic showing of the air flow shown over and through the insulation layer; 16A
Figure 7:
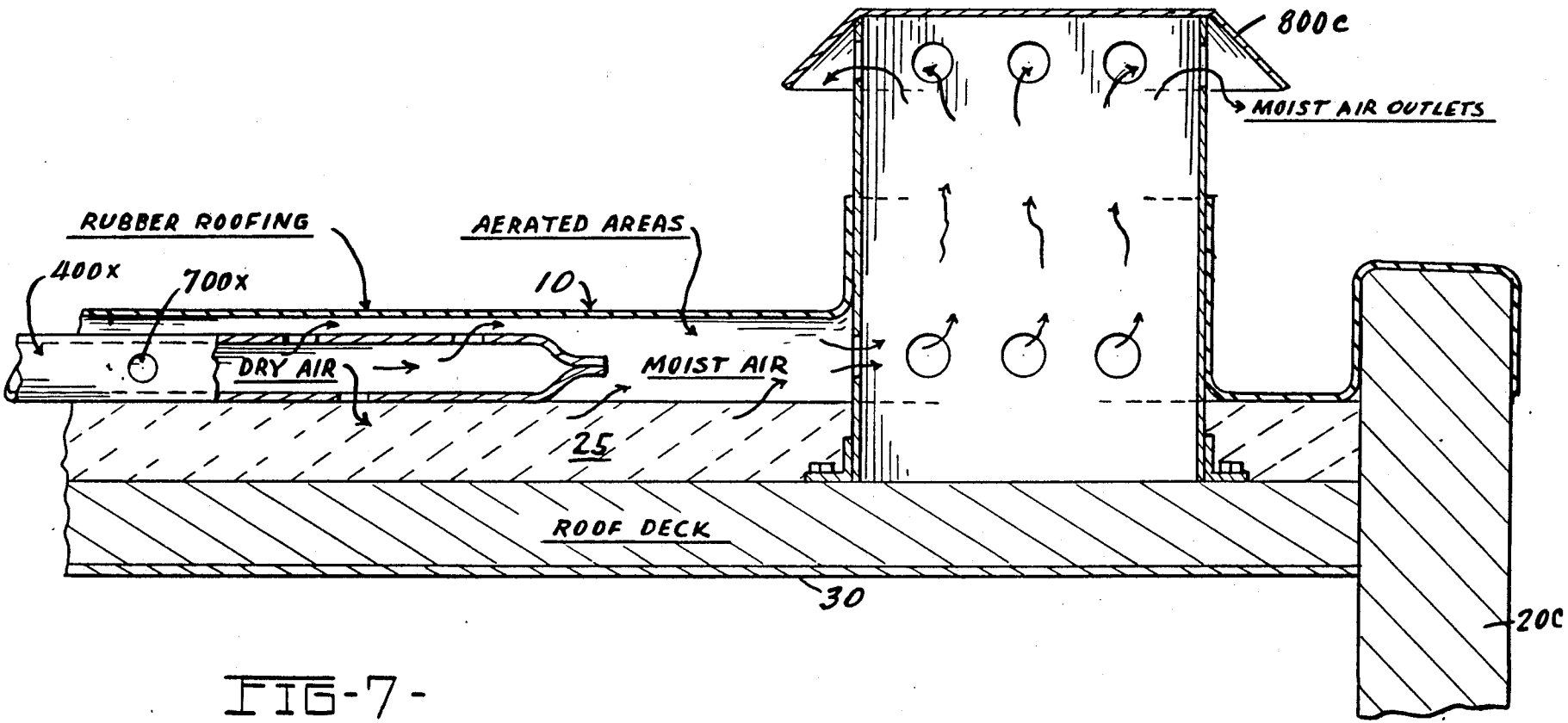
FIG. 7 is a side elevational view in cross-sectional configuration 16B of the overall air distribution system on which the subject invention is based.

Referring now to FIGS. 3 and 4 which provide detailed views of the distribution plenum used to disperse intake air to the various pipes 400A, 400B . . . that comprise the arteries of the distribution system. The distribution plenum is generally comprised of a parallelopiped shaped box-like member, having a hollow chamber, in which chamber intake air is drawn for distribution to the various connecting pipes 400A, 400B, 400C. It is to be noted in this respect that the distribution plenum can be other than a parallelopiped shape as the outer structural configuration of such plenum is not of critical significance.

As shown, the distribution plenum has an opening on the upper shelf or outer surface which communicates directly with the air intake unit so as to allow a free flow of intake air from the air intake unit directly to the interior chamber of the distribution plenum. As can be seen, the interior chamber of the distribution plenum is regularly shaped, but may be of any shape or configuration.

Moreover, in the preferred embodiment of the subject invention, the distrubtion pipes 400A, 400B are connected to the outlet openings 430A, 430B, 430C . . . so that the internal chamber 440A, 400B . . . of such distribution pipe members communicate with such openings 430A, 430B and thus the internal chamber of the plenum, as seen in the drawings Moreover, in the preferred embodiment of the subject invention, it is to be noted that each distribution pipe has a plurality of openings therein to evenly disperse the air passing through each such distribution pipe. More particularly, distribution pipe 400A has a plurality of openings 500A, 500C . . . 500Z that are evenly distributed along the distribution pipe all along the length of the pipe 400A. In the preferred embodiment of the subject invention, the openings 500A, 500B are structured in size with the openings nearest the plenum being smaller in size near the plenum with the openings becoming progressively larger as the pipe extends further away from the plenum. More particularly, the openings 500Aa, 500B . . . 500Z in the distribution pipes are dispersed evenly over the length and circumference of the distribution pipe, with the openings being generally gradually larger as the pipe extends further away from the plenum to the point where the openings are largest at the end of the distribution pipe.

As described, the foregoing process is a mechanical operation on the arbitrary act of turning motor 110 on or off to actuate the intake fan 115 in the intake system. This action is dependent on the judgment of the operator as to the need to use the subject system at any given time, and can be implemented strictly by a manual actuation of air appropriately placed and connected to an on and off switch, not shown in the drawings.

In the subject control system, an automatically-controlled air flow is used between the undersurface of the upper roof cover 10 and the insulation layer 25 in order to facilitate the evaporation of moisture in these spatial areas of the roof structure. Moreover, in the subject system, a central sensor system 1000 is used for coordinating control and operation of the system. This sensor 1000, shown schematically in FIGS. 3 and 8, is adapted to control the process of shutting off or turning on the blower fan 120, which functions to draw relatively dry air into the system to commence the drying procedures, as more fully described above.

Figure 8:
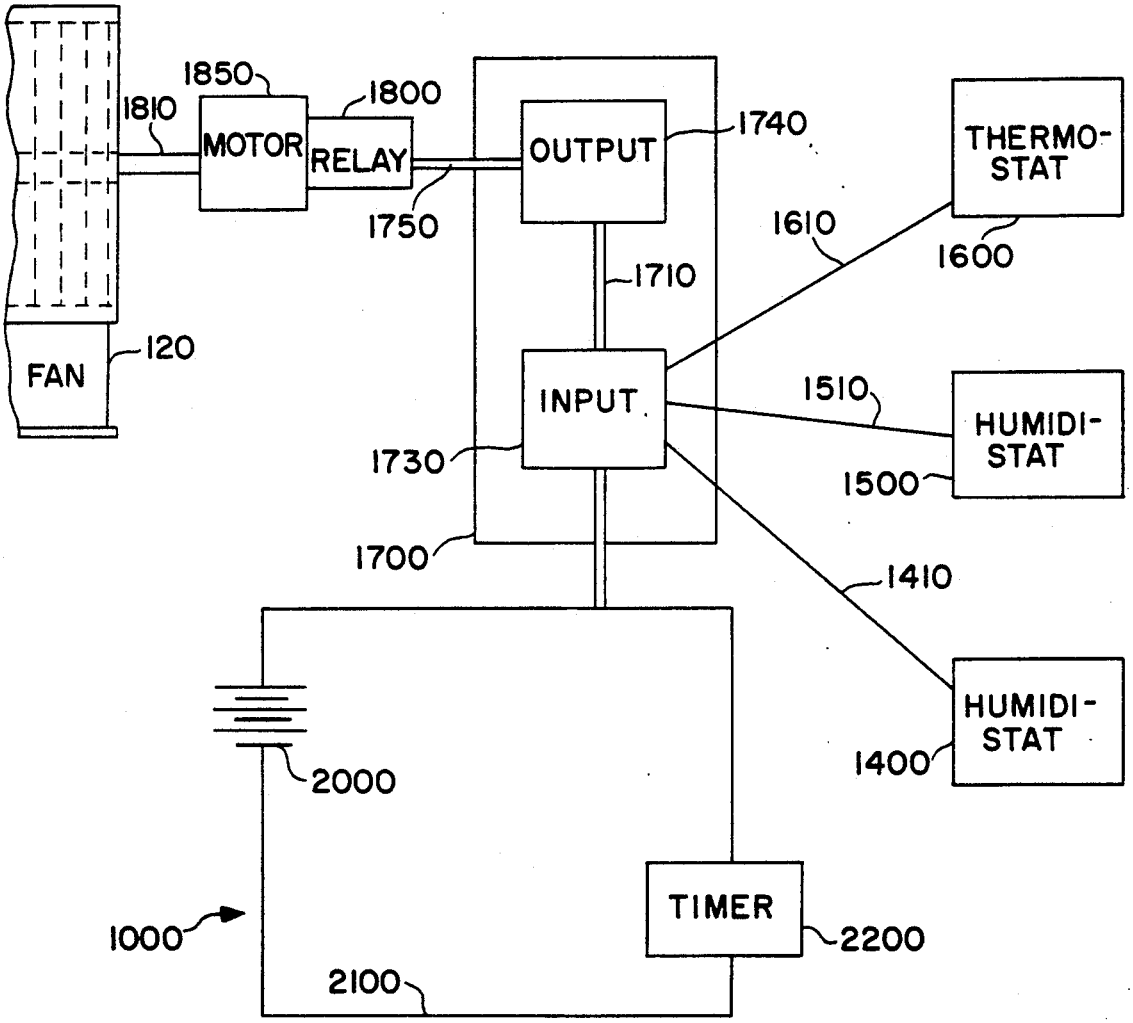
FIG. 8 is a schematic view of the automatic sensing system used in conjunction with the subject invention.

Furthermore, in the preferred embodiment, as seen in FIG. 8, the overall control system has preferably three sensors, including humidstats 1400 and 1500, as well as a thermostat 1600. However, it is not critical to implementation of the subject invention that the precise number of sensors be three, but can be less or more. Additionally, a photostat, not shown, may be optionally employed to allow operation of the subject system only during daylight hours. This latter feature is optional and not critical to implementation of the subject invention. Humidstat 1400 is preferably located within the blower housing and is adapted to sense outside ambient relative humidity. Additionally, in the preferred embodiment of the subject invention, theremostat 1600 is integrally placed in the blower housing to sense outside temperature levels. The thermostat 1600 is adapted to provide a sensing-signal to shut off the motor 110 whenever the outside temperature levels drop to a predetermined arbitrary level, preferably somewhere above freezing levels. On the other hand, the humidstat 1400 functions to sense specified relative humidity levels and signal for a shutdown of the motor 110 whenever humidity levels reach a predetermined level, for example, a relative humidity level of eighty percent, as an arbitrary level. By this arrangement, the subject system will not operate in cold weather or high humidity conditions.

The second humidstat 1500 is preferably located within the insulation layer itself, preferably in a housing. This second humidstat 1500 functions to detect humidity levels within the insulation level 25 itself. This latter humidstat 1500 will serve to send a signal to actuate the motor 110 to operate the blower fan 120 whenever the humidity level in the insulation layer 25 reaches a given level, or conversely signals to cut off the motor 110 whenever the humidity level in the insulation level drops to a given arbitrary level. In yet another embodiment of the subject invention, a timer unit may be integrated into the system to automatically signal for turning the system off at given arbitrary intervals.

Relative to the subject invention, and in specific reference to FIG. 8, as shown, the three sensors 1400, 1500 and 1600, as shown, operate in the sensing system 1000 in the following described manner. Sensor 1400, being a humistat, will sense a relative humidity level of a given arbitrary amount in the ambient outside air. When the relative humidity reaches such a level, sensor 1400 will transport an electrical signal through electrical lead 1410 to the central control unit 1700. Central control unit 1700 comprises an input unit 1730 and an output unit 1740. The signal from the humidity sensor 1400 enters the input unit 1730 and is transferred to the output unit 1740 by way of lead line 1710 where it is converted to yet another appropriate electrical signal. This latter electrical signal is thence transferred by way of lead line 1750 to relay switch 1800. Relay switch 1800, in turn, activates motor 1850 to which is rotatably mounted fan 120 through rotatable shaft 1870.

In similar fashion, sensor 1500, which is a humistat disposed in the insulation layer 25, functions to activate and transfer an electrical signal by way of lead lines 1510 to the control unit 1700, which processes the signal in the same fashion as described above for electrical signals from sensor 1400. Still in similar fashion is the handling of the electrical signals emanating from sensor 1600, which is a thermostat, and these signals are transmitted along lead lines 1670 to the control unit 1060 and are processed in a similar manner.

As shown in FIG. 8, a power source 2000 is integrated in circuitry 2100 leading to and from the control unit 1700 to provide power for the system. Also integrally affixed in the circuitry 2100 is a timer 2200 adapted to turn on and off the entire system at arbitrary intervals.

The subject moisture control system works in conjunction with the described control system in the following manner. Dry air is drawn into the air intake system through the actuation of the motor which, in turn, actuates the intake fan 120. Such dry air is drawn through the plenum into the distribution header 200 from which the air is distributed to the various distribution pipes 400A, 400B . . . where the air is passed through the openings 500A, 500B to adjacent insulation areas for the dehumidifying process. As described, the foregoing process is a mechanical operation dependent on the arbitrary art of turning motor 110 on or off, depending on the judgment of the operator as to the need to use the subject system at any given time.

In the subject control system, a controlled air flow is used between the undersurface of the roof deck 25 and the insulation layer 30 in order to facilitate the evaporation of moisture in these spatial areas of the roof structure. Moreover, in the subject system, a control system 1000 is used for coordinating control.

I claim:

1. An air ventilation system for a roof infrastructure for a building comprising:

(a) an air intake member disposed adjacent said building;

(b) mechanical power means on said air intake member adapted to activate the flow of intake air into said building and its roof infrastructure;

(c) air distribution pipes connected to said air intake member adapted to disburse air into the roof infrastructure;

(d) air outlet means on said building to vent air therefrom and from roof infrastructure;

(e) thermostat sensor means affixed outside said building, said thermostat sensor means connected electrically to said mechanical power means to signal and cause activation of said mechanical power means to draw air into the air intake member and into the building, said thermostat sensor means adapted to send an electrical signal to said mechanical power means to activate same whenever the temperature level in the outside of the building reaches a predetermined level;

(f) first humistat sensor means located outside the building and adapted to sense relative humidity levels outside the building, said first humistat sensor being electrically connected to said mechanical power means to signal and cause activation of said mechanical power means to draw air into the air intake member and into the building, said first humistat sensor adapted to send an electrical signal to said mechanical power means to activate same whenever the relative humidity level outside the building reaches a predetermined level;

(g) second humistat sensor means located inside the building and adapted to sense relative humidity levels inside the building, said second humistat sensor being electrically connected to said mechanical power means to signal and cause activation of said mechanical power means to draw air into the air intake member and into the building, said second humistat sensor adapted to send an electrical signal to said mechanical power means to activate same whenever the relative humidity level inside the building reaches a predetermined level.

2. An air ventilation system for a roof infrastructure for a building comprising:

(a) an air intake member disposed on the outside of the building;

(b) mechanical power means on said air intake member adapted to activate the flow of intake air into said building and roof infrastructure;

(c) air distribution pipes connected to said air intake member adapted to disburse air to the roof infrastructure;

(d) air outlet means on said building to vent air therefrom and from roof infrastructure;

(e) thermostat sensor means affixed outside said building, said thermostat sensor means connected electrically to said mechanical power means to signal and cause activation of said mechanical power means to draw air into the air intake member and into the building, said thermostat sensor means adapted to send an electrical signal to said mechanical power means to activate same whenever the temperature level in the outside of the building reaches a predetermined level;

(f) first humistat sensor means located outside the building and adapted to sense relative humidity levels outside the building, said first humistat sensor being electrically connected to said mechanical power means to signal and cause activation of said mechanical power means to draw air into the air intake member and into the building, said first humistat sensor adapted to send an electrical signal to said mechanical power means to activate same whenever the relative humidity level outside the building reaches a predetermined level;

(g) second humistat sensor means located inside the building and adapted to sense relative humidity levels inside the building, said second humistat sensor being electrically connected to said mechanical power means to signal and cause activation of said mechanical power means to draw air into the air intake member and into the building, said second humistat sensor adapted to send an electrical signal to said mechanical power means to activate same whenever the relative humidity level inside the building reaches a predetermined level.

* * * * *